US007294228B2

(12) United States Patent
Huang et al.

(10) Patent No.: US 7,294,228 B2
(45) Date of Patent: Nov. 13, 2007

(54) BIOPULP FOR NON-WOODY FIBER PLANTS AND BIOPULPING METHOD THEREOF

(75) Inventors: Jenn-Wen Huang, Taiping (TW); Yu-Hsiang Peng, Linkou Shiang (TW)

(73) Assignee: Yuen Foong Yu Paper Mfg. Co. Ltd., Taipei (TW)

( * ) Notice: Subject to any disclaimer, the term of this patent is extended or adjusted under 35 U.S.C. 154(b) by 142 days.

(21) Appl. No.: 10/783,550

(22) Filed: Feb. 20, 2004

(65) Prior Publication Data

US 2004/0163780 A1 Aug. 26, 2004

(30) Foreign Application Priority Data

Feb. 26, 2003 (TW) ..... 92104112 A

(51) Int. Cl.
*D21C 3/20* (2006.01)

(52) U.S. Cl. ..... 162/72; 162/70; 162/1; 435/278

(58) Field of Classification Search ..... 162/72, 162/13, 82, 83, 91, 92, 94, 95, 96, 97, 98, 162/99; 435/277, 278
See application file for complete search history.

(56) References Cited

U.S. PATENT DOCUMENTS

| | | | | |
|---|---|---|---|---|
| 1,639,152 | A * | 8/1927 | Sweeney | 435/278 |
| 2,766,176 | A * | 10/1956 | Jeffreys | 435/252.4 |
| 4,643,899 | A * | 2/1987 | Kerr et al. | 426/2 |
| 4,687,745 | A * | 8/1987 | Farrell | 435/278 |
| 5,005,345 | A | 4/1991 | Pinckard et al. | |
| 5,344,647 | A * | 9/1994 | Rossall | 424/93.462 |
| 5,427,945 | A * | 6/1995 | Blanchette et al. | 435/278 |
| 5,589,381 | A * | 12/1996 | Neyra et al. | 435/252.5 |
| 5,677,161 | A * | 10/1997 | Rosenberg et al. | 435/200 |
| 6,383,246 | B1 | 5/2002 | Konishi et al. | |
| 6,387,690 | B1 * | 5/2002 | Schulein et al. | 435/263 |
| 6,402,887 | B1 * | 6/2002 | Akhtar et al. | 162/13 |
| 6,451,063 | B1 | 9/2002 | Clarkson et al. | |
| 6,896,883 | B2 * | 5/2005 | Bergstrom et al. | 424/93.462 |
| 2004/0172997 | A1 * | 9/2004 | Huang et al. | 71/23 |
| 2004/0194370 | A1 * | 10/2004 | Huang et al. | 47/9 |
| 2005/0266521 | A1 * | 12/2005 | Yoneda et al. | 435/69.1 |

FOREIGN PATENT DOCUMENTS

| | | |
|---|---|---|
| CN | 1395002 A | 2/2003 |
| EP | 1 088 937 | 4/2001 |
| JP | 05209385 | 8/1993 |

OTHER PUBLICATIONS http://www.spiraxsarco.com/esc/SS_Properties.aspx?lang_id=ENG&country_id=HQ.*

* cited by examiner

*Primary Examiner*—Eric Hug
*Assistant Examiner*—John B. Edel
(74) *Attorney, Agent, or Firm*—Volpe & Koenig PC

(57) ABSTRACT

The present invention relates to a biopulping method, and more particularly to a biopulping method for non-woody fiber plants. A biopulping method for a non-woody fiber plant is provided. It includes steps of providing a culture solution, adding a non-woody fiber plant to the culture solution, adding a microorganism suspension to the culture solution, fermentatively culturing the culture solution for preparing a pulp solution, boiling the pulp solution, pulping the pulp solution, and screening the pulp solution for isolating the paper pulp from the pulp solution.

16 Claims, 6 Drawing Sheets

BIOPULP FOR NON-WOODY FIBER PLANTS AND BIOPULPING METHOD THEREOF

FIELD OF THE INVENTION

The present invention provides a biopulp and a biopulping method thereof, and more particularly a biopulp for non-woody fiber plants and a biopulping method thereof.

BACKGROUND OF THE INVENTION

The paper-making industry is a universally traditional industry. The development of the paper-making industry is the index of the economy and living standard for a country. The source of paper pulp mostly comes from woods. (It needs four metric tons of wood to produce one metric ton of paper pulp. This means cutting down twenty-three trees.) Because of that, the forest area on the earth has been and is rapidly decreasing. The ecological balance problem becomes more and more serious. Furthermore, a great quantity of water and chemicals are needed to wash pulp. However, waste liquid from the wash is discharged from a factory in the traditional chemical paper-making process. This also results in environmental pollution. The rivers and oceans are polluted. Nowadays, people in the whole world pay much attention to environmental protection. Corporations in the paper-making industry are obliged to spend money to improve environmental quality. The paper production costs are thus raised. Those problems really strike against the paper-making industry.

The annual yield of rice straws is about 2300 thousand metric tons in Taiwan. The organic components of rice straws are almost more than 95%. The organic components include 41.3% carbon, 0.81% hydrogen, 20.6% hemicellulose, 24.7% cellulose and 7.7% lignin. Conventionally, the handling methods for rice straws include manufacturing them into straw ropes, straw bags, straw mats and cardboards, serving them as covering materials for a plot of land, utilizing them as fuel, and mixing them with other material to produce a compost. Also, rice straw could be directly buried in soil or burned for recyclably using the nutrition. Nowadays, the rice straws are rarely used as fuel, feed, straw bags or straw mats because of the expensive costs and advanced science and technology. Most of the rice straws are locally burned or directly buried in soil, which often result in environmental pollution. On the other hand, since the rice straws are rich in fiber, it will be very helpful to mitigate the environmental pressure of logging the trees for papermaking if the non-woody fiber plants could be well developed and used. In the past, the fiber production methods using non-woody fiber plants as original material were generally chemical or semi-chemical methods. However, there exists three difficult problems in the paper-making industry resulting from the chemical production method for pulp. They are described as follows. (1) Large amounts of silicates and black liquid with high viscosity produced in the process often result in serious problems in recycle systems. (2) The deposition of calcium carbonate will be affected by the silicates and thus will lead to the dirt appearance attached on the vapor apparatus. In addition, the evaporator piping gets undesirable black viscous liquid attached thereon. Therefore, it needs to be shut down for cleaning. (3) The unstable status of the steamer and boiling machines waste the fuel and thus raise the production costs.

Biotechnology is the key for reorganizing the traditional industry structure. It is very important for the papermaking industry to move towards the use of the biotechnology for papermaking. The advantages of using biotechnology for papermaking are the reduction of production cost, the improvement of pulp quality and the safety maintenance of the working environment, etc. There are many methods and products produced, for example, the removal of gum or printing ink by using enzymes, paper bleaching by using xylanase or lignin oxidizing enzyme, and the improvement of pulp viscosity by using enzymes (non-woody fiber pulp especially). However, these methods also have the drawbacks of environmental pollution caused by waste liquid and energy consumption. Therefore, it is imperative to seek the assistance of biotechnology for solving and overcoming the drawbacks of papermaking by using chemical methods.

Researchers in many countries of Europe and America attempt to use white-rot fungi, such as *Phanerochaete chrysosporium* and *Cereporiopsis subvermispora*, grown on wood slices for removing the lignin of woods and saving the cost and energy of paper making. Although there are some positive results from those methods, it takes too much time for the industry to grow the white-rot fungi on woods outdoors.

The main purpose of the present invention is to apply the decomposition abilities of microorganisms for decomposing organic matter in the papermaking processes of waste straws so as to establish a model of biopulping processes for non-woody fiber plants. The non-woody fiber plants will become an important source of the raw materials of paper pulp. This approach can decrease the consumption of forest resources and the production of chemical wastes. The existing problems of papermaking are solved.

From the above description, developing a new pulping method with the advantages of low production costs, low or non pollution has become a major problem to be solved. In order to overcome the drawbacks in the prior art, a biopulp for non-woody fiber plants and a biopulping method thereof is provided. The particular design of the present invention not only solves the problem described above, but also uses the waste rice straws and a biopulping method to produce paper pulp for paper-making. It does not need to use the chemical or semi-chemical method, and therefore no pollution problems exist.

Therefore, the present invention provides a biopulp for non-woody fiber plants and a biopulping method thereof which overcomes the disadvantages described above.

SUMMARY OF THE INVENTION

It is an object of the present invention to apply the decomposition abilities of microorganisms for decomposing the organic matters in the papermaking processes of waste straws so as to establish a model of biopulping processes of a non-woody fiber plant. The non-woody fiber plants will become an important source of the raw materials of paper pulp. This approach can decrease the consumption of forest resources and reduce or eliminate chemical pollution.

It is another object of the present invention to provide a biopulping method for recycling waste straws and decreasing the cost of papermaking.

In accordance with an aspect of the present invention, a production method for a paper pulp includes steps of providing a culture solution, adding a fiber plant into the culture solution, adding a suspension of a microorganism into the culture solution, fermentatively culturing the culture solution for preparing a pulp solution, boiling the pulp solution, pulping the pulp solution, and screening the pulp solution for isolating a paper pulp from the pulp solution.

Preferably, the fiber plant is a non-woody fiber plant.

Preferably, the fiber plant is pretreated by one selected from the group consisting of a relatively high pressure treatment under a relatively high temperature, a steaming treatment under a relatively high temperature, a boiling treatment under a relatively high temperature, a fumigated treatment and a soaking treatment under a room temperature.

Preferably, the fiber plant is added into the culture solution in a ratio ranged from 4 to 15% (w/v).

Preferably, the microorganism is isolated from one of a non-woody fiber plant and a livestock excrement compost.

Preferably, the microorganism is inoculated at a concentration ranged from 0 to $10^8$ cfu/ml.

Preferably, the microorganism is a Gram positive bacterium.

Preferably, the microorganism is one selected from the group consisting of a *Bacillus licheniformis* (PMBP-m5), a *Bacillus subtilis* (PMBP-m6) and a *Bacillus amyloliquefaciens* (PMBP-m7).

Preferably, the fermentatively culturing process proceeds at a temperature ranged from 20 to 50° C.

Preferably, the fermentatively culturing process is one of a static culture and a shaking culture.

Preferably, the fermentatively culturing process proceeds over 0 to 10 days.

Preferably, the step of boiling the pulp solution further includes a step of adding 0 to 4% (w/v) CaO into the pulp solution and boiling the pulp solution for 25 to 40 minutes at a temperature ranged from 120 to 150° C.

Preferably, the pulp solution is screened by 18 to 300 meshes.

In accordance with another aspect of the present invention, a biopulping method for a non-woody fiber plant includes steps of providing a culture solution, adding a non-woody fiber plant into the culture solution, adding a suspension of a microorganism into the culture solution, fermentatively culturing the culture solution for preparing a pulp solution, boiling the pulp solution, pulping the pulp solution, and screening the pulp solution for isolating a paper pulp from the pulp solution.

Preferably, the fiber plant is pretreated by one selected from a group consisting of a relatively high pressure treatment under a relatively high temperature, a steaming treatment under a relatively high temperature, a boiling treatment under a relatively high temperature, a fumigated treatment and a soaking treatment under a room temperature.

Preferably, the inoculation concentration of a microorganism is at a range from 0 to $10^8$ cfu/ml.

Preferably, the microorganism is one selected from a group consisting of a *Bacillus licheniformis* (PMBP-m5), a *Bacillus subtilis* (PMBP-m6) and a *Bacillus amyloliquefaciens* (PMBP-m7).

Preferably, the step of boiling the pulp solution further includes a step of adding 0 to 4% (w/v) CaO into the pulp solution and boiling the pulp solution for 25 to 40 minutes at a temperature ranged from 120 to 150° C.

Preferably, the pulp solution is screened by 18 to 300 meshes.

In accordance with another aspect of the present invention, a biopulp of a non-woody fiber plant, includes the components of a non-woody fiber plant and a suspension of a microorganism. The non-woody fiber plant and the suspension of the microorganism suspension are mixed and fermentatively cultured for preparing the biopulp.

Preferably, the microorganism is a Gram positive bacterium.

Preferably, the microorganism is one selected from a group consisting of a *Bacillus licheniformis* (PMBP-m5), a *Bacillus subtilis* (PMBP-m6) and a *Bacillus amyloliquefaciens* (PMBP-m7).

The foregoing and other features and advantages of the present invention will be more clearly understood through the following descriptions with reference to the drawings, wherein:

DETAILED DESCRIPTION OF THE PREFERRED EMBODIMENT (A) The effects of various rice straw treatments on the decomposition of rice straws:

The waste rice straws of Japonica rice (*Oryza sativa* L. subsp. *japonica*) and Indica rice (*Oryza sativa* L. subsp. *indica*) are provided. The rice straws are sun-dried, cut into small segments at the length of 2-3 cm and pretreated in different ways. For example, the rice straws are pretreated by an autoclave treatment (121° C., 15 lb/in$^2$ for 15 minutes), a steaming treatment under a relatively high temperature (100° C. for 30 minutes), a boiling treatment under a relatively high temperature (100° C. for 30 minutes), a fumigated treatment (Propylene oxide treatment for one day), or a soaking treatment under a room temperature (25 to 30° C. for 30 minutes). The various treatments of rice straws can further affect the pulp recovery efficiency. The detailed steps are described as follows. The rice straws are treated by an autoclave treatment (121° C., 15 lb/in$^2$ for 15 minutes), a soaking treatment under a room temperature (25 to 30° C. for 30 minutes), a fumigated treatment (Propylene oxide treatment for one day) and a steaming treatment under relatively high temperature (100° C. for 30 minutes) respectively. The pretreated rice straws are added into the flasks containing 100 ml sterile water at the amount of 5% (w/v) and then respectively incubated at 50° C. and 200 rpm shaking culture and static culture for a week. Each treatment has duplicate samples. The changes of the rice straws are observed. The decomposition percentage of rice straws is investigated and recorded.

Figure 1:
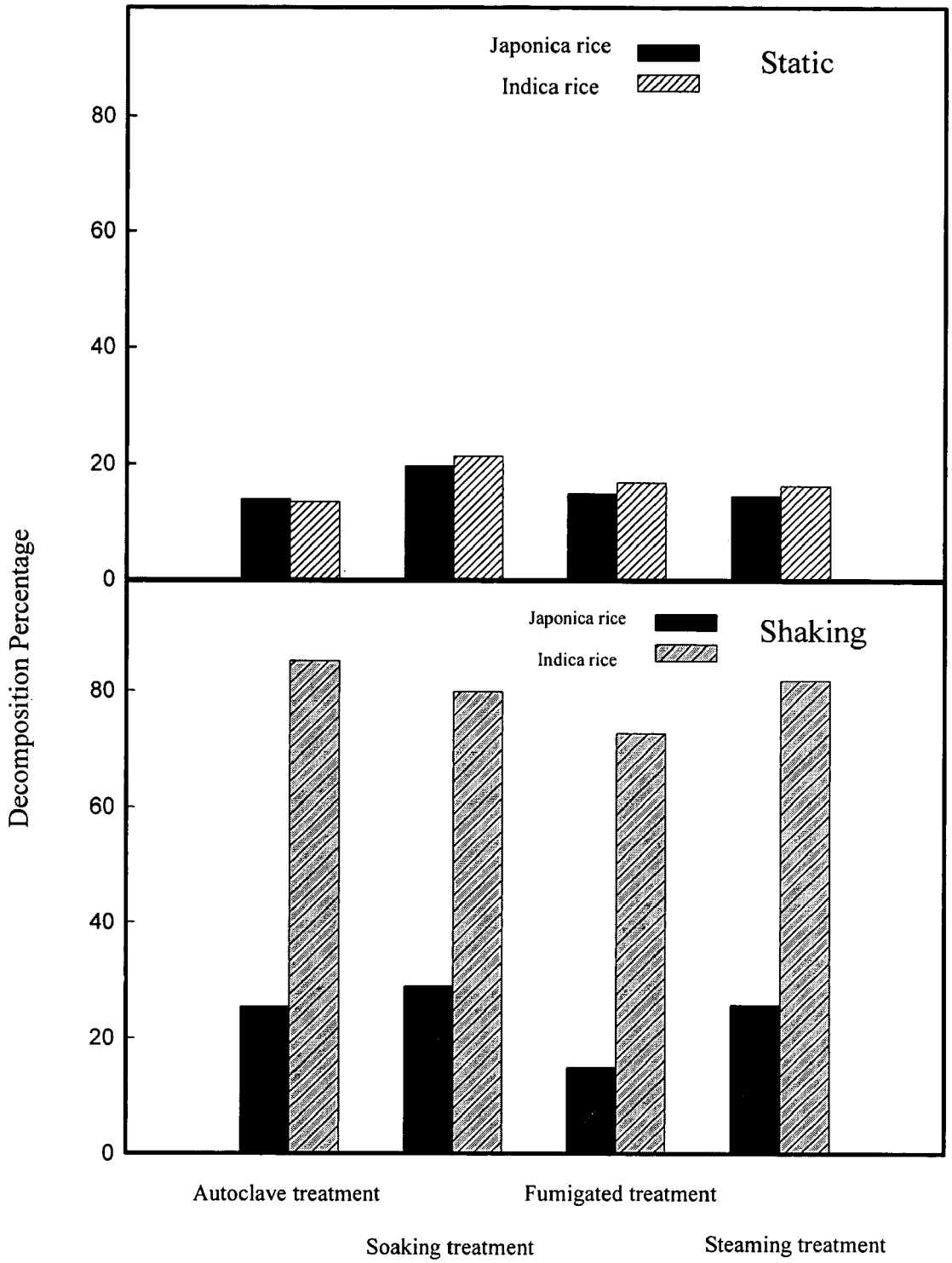
FIG. 1 is a graph showing the effects of different treatments on the decomposition percentages of rice straw.

Please refer to FIG. 1, which shows the effects of different treatments on the decomposition percentages of rice straw wherein the treatments include an autoclave treatment (121° C., 15 lb/in$^2$ for 15 minutes), a soaking treatment under a room temperature (25 to 30° C. for 30 minutes), a fumigated treatment (Propylene oxide treatment for one day), and a steaming treatment under relatively high temperature (100°

C. for 30 minutes). The decomposition percentage of rice straws is calculated by the following formula.

$$\text{Decomposition \%} = \frac{(\text{Total dry weight of fermentative rice straws} - \text{Dry weight of intact rice straws})}{(\text{Total dry weight of fermentative rice straws})} \times 100$$

The results reveal that the shaking culture is helpful to increase the decomposition of rice straws. After the shaking culture, the decomposition percentage of rice straws of Indica rice is obviously higher than that of Japonica rice. The decomposition percentage of the fumigated (Propylene oxide) treatment is quite low in both shaking culture and static culture. It indicates that the microorganisms on the surface of the rice straws are disinfected by the Propylene oxide. Therefore, very few microorganisms are left in the sample treated with propylene oxide. Comparing the effect of the soaking treatment under a room temperature with the effect of the fumigated treatment, it is proved that the microorganisms are helpful to the decomposition of rice straws. With regard to the steaming treatment under a relatively high temperature, the boiling treatment under a relatively high temperature and the soaking treatment under room temperature, they are all helpful to the decomposition of rice straws. By shaking culture, the aerobic fermentation speeds up the decomposition of the rice straws by the microorganisms.

(B) The selection of bacterial strains having decomposition ability:

The microorganism strains are obtained by the following method according to a preferred embodiment. First, 10 g of the rice straws and 10 g of livestock excrements are prepared and added into 90 ml of sterile water containing agar (0.1%, w/v). The materials are well mixed and diluted. Then, 0.1 ml of $10^3\times$ and $10^4\times$ diluted solution are uniformly spread on a Nutrient Agar plate, pH 8 (NA, purchased Nutrient Agar from Difco company) and a Potato Dextrose Agar plate, pH 8 (PDA, purchased Potato Dextrose Agar from Difco company) respectively. Next, the plates are placed in the incubators under 30° C. and 50° C. for 24 hours and 48 hours respectively. Single colonies grown on plates are picked and isolated for obtaining the microorganism strains. The number of microorganisms isolated from the rice straws and the livestock excrements having the decomposition ability is more than 200 strains. Finally, the microorganisms are identified by the Gram stain. It is found that most of the microorganisms are Gram-positive bacteria.

The isolated microorganisms are further selected by the following steps for selecting the microorganism strains having the decomposition ability for rice straws. (1) 19 strains of the isolated strains, named PMBP-m1, PMBP-m2, PMBP-m3, PMBP-m4, PMBP-m5, PMBP-m6, PMBP-m7, PMBP-O1, PMBP-O2, PMBP-O3, PMBP-O4, PMBP-e1, PMBP-e2, PMBP-e3, PMBP-e4, PMBP-H1, PMBP-H2, PMBP-H3 and PMBP-H4 (as shown in Table 1), are divided into 9 strain groups, including PMBP-I, PMBP-II, PMBP-III, PMBP-IV, PMBP-V, PMBP-VI, PMBP-O, PMBP-E and PMBP-H. Please refer to Table 1, which shows the bacterial strains of different strain groups and the characteristics thereof. (2) The strain groups are cultured with NA plate media respectively and then a suspension of a microorganism is prepared at the concentration of $10^8$ cfu/ml. (3) 100 ml of solution containing rice straws of Japonica rice (5%, w/v) is prepared. (4) 1 ml of the microorganism suspension is added into the sterile solution prepared in step (3) and then cultured under 50° C. and 200 rpm shaking for a week. Each strain is set up in duplicate. (5) The decomposition percentage of rice straws is calculated.

TABLE 1

| | Characteristics | | |
|---|---|---|---|
| Isolate | Temp. 50° C. | pH8 | Gram stain (+/−) |
| PMBP-m1 | ++ | + | + |
| PMBP-m2 | ++ | + | + |
| PMBP-m3 | ++ | + | + |
| PMBP-m4 | ++ | + | + |
| PMBP-m5 | ++ | + | + |
| PMBP-m6 | ++ | + | + |
| PMBP-m7 | ++ | + | + |
| PMBP-O1 | ++ | + | + |
| PMBP-O2 | ++ | + | + |
| PMBP-O3 | ++ | + | + |
| PMBP-O4 | ++ | + | + |
| PMBP-e1 | ++ | + | + |
| PMBP-e2 | ++ | + | + |
| PMBP-e3 | ++ | + | + |
| PMBP-e4 | ++ | + | + |
| PMBP-H1 | ++ | + | + |
| PMBP-H2 | ++ | + | + |
| PMBP-H3 | ++ | + | + |
| PMBP-H4 | ++ | + | + |

Figure 2:
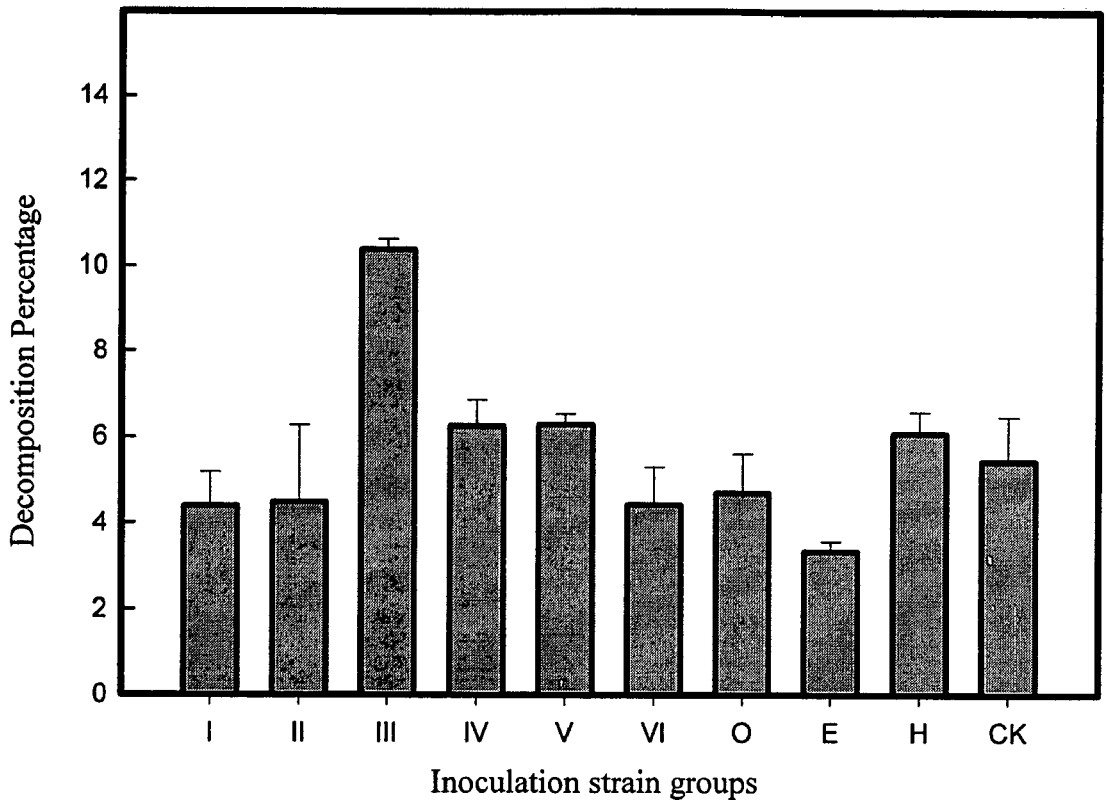
FIG. 2 is a graph showing the ability of various strains to decompose the rice straw of Japonica rice.

Please refer to FIG. 2, which shows the ability of various strains to decompose the rice straw of Japonica Rice. The Japonica rice straws treated with shaking culturing for a week are classified, dried and weighted. The decomposition percentage of rice straws treated with different microorganisms is calculated by the following formula.

$$\text{Decomposition \%} = \frac{(\text{Total dry weight of fermentative rice straws} - \text{Dry weight of intact rice straws})}{(\text{Total dry weight of fermentative rice straws})} \times 100$$

As shown in FIG. 2, the PMBIII strain group has the best decomposition ability than the others. The decomposition percentage of rice straws is about 10.38%. The PMBIII consists of *Bacillus licheniformis* (PMBP-m5) (Patent Deposit Designation: PTA-5824, deposited on Feb. 18, 2004 with the American Type Culture Center, Manassas, Va. 20110-2209, USA), *B. subtilis* (PMBP-m6) (Patent Deposit Designation: PTA-5818, deposited on Feb. 13, 2004 with the American Type Culture Center, Manassas, Va. 20110-2209, USA), and *B. amyloloquefaciens* (PMBP-m7) (Patent Deposit Designation: PTA-5819, deposited on Feb. 13, 2004 with the American Type Culture Center, Manassas, Va. 20110-2209, USA).

(C) The production of biopulp by utilizing bacteria with different inoculation concentrations:

The waste rice straws are the materials for producing the biopulp. Different inoculation concentrations of bacteria are added to decompose the rice straws and the decomposition effects thereof on rice straws are compared. The steps are as follows.

(1) Preparation of culture solution: A LBY culture solution containing 0.25% lactose, 0.2% beef extract and 0.05% Yeast extract is prepared.

(2) Preparation of waste rice straws for testing: The waste rice straws are collected. The cultivated variety of rice is Taichung Sheng No. 10 (Indica rice). The rice straws are sun-dried and cut into small segments at a length of 2-3 cm.

(3) Fermentatively shaking culture: The PMBIII strain group consisting of *Bacillus licheniformis* (PMBP-m5), *B. subtilis* (PMBP-m6) and *B. amyloliquefaciens* (PMBP-m7) is picked and the suspension of PMBIII strain group is prepared. 1000 ml of concave-bottom flasks containing 500 ml LBY culture solution is prepared. The bacteria suspensions of the PMBIII strain group are added into the culture solution at the concentrations of $1.5\times10^4$ cfu/ml (LBY-4 treatment), $1.5\times10^6$ cfu/ml (LBY-6 treatment) and $1.5\times10^8$ cfu/ml (LBY-8 treatment) respectively. The culture solution without adding any bacteria suspension is the control (LBY-1 treatment). The rice straw segments are added into the culture solutions at the amount of 0.5% (w/v). And then the culture solutions are fermented in shaking culture under 50° C., 200 rpm for a week. Each concentration of bacteria is set up in four repetitions to prepare a pulp solution.

Figure 3:
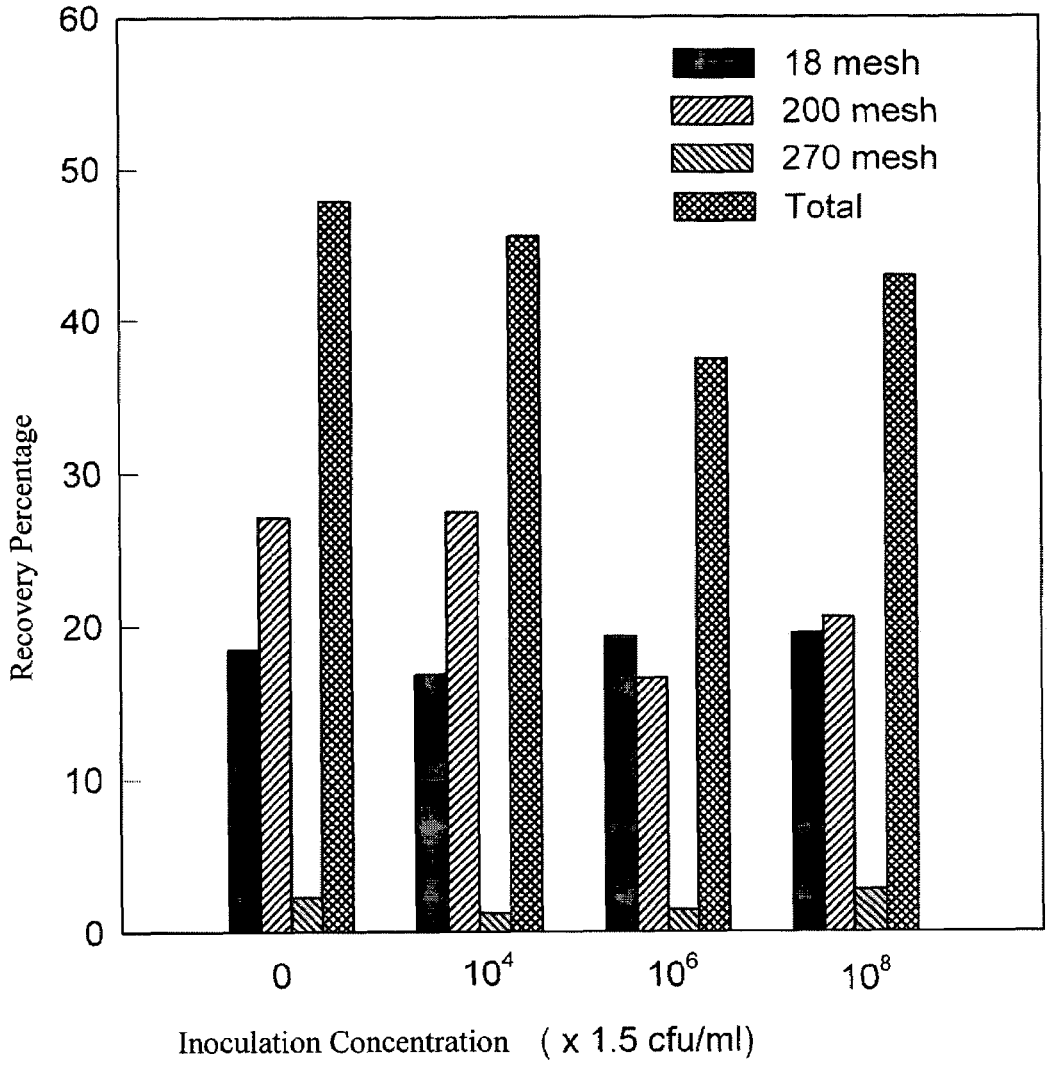
FIG. 3 is a graph showing the effects of different inoculation concentrations of PMBIII strain groups on the recovery percentages of the rice straw pulp fibers.

The results are shown in FIG. 3 and Table 2. FIG. 3 shows the effects of different inoculation concentrations of PMBIII strain group on the recovery percentages of the rice straw pulp fibers. The recovery percentages of rice straw pulp fibers are slightly decreased with increased inoculation concentrations of PMBIII strain group. High inoculation concentration of PBMIII strain group has no significant effect on the decomposition of rice straws. Please refer to Table 2, which shows the comparisons of physical properties of handmade papers made from the pulp treated with different inoculation concentrations of bacteria. The permeability of gases and the general strength of handmade papers of the LBY-6 treatment (the inoculation concentration is $1.5\times10^6$ cfu/ml) are better than the others. The characteristic differences among the papers treated with other inoculation concentration of bacteria are not significant. However, the general strengths of the papers treated with the inoculation of bacteria are all higher than that of the control (LBY-1) which is treated without the inoculation of bacteria.

TABLE 2

| | Treatment | | | |
|---|---|---|---|---|
| Test item | LBY-1 C.S.F.:143 ml | LBY-4 C.S.F.:162 ml | LBY-6 C.S.F.:137 ml | LBY-8 C.S.F.:212 ml |
| Basic weight ($g/m^2$) | 72.4 | 71.0 | 71.7 | 71.4 |
| Thickness (mm) | 0.134 | 0.126 | 0.124 | 0.125 |
| Bulk (ml/g) | 1.85 | 1.77 | 1.73 | 1.75 |
| Breaking length (Km) | 5.74 | 5.69 | 6.24 | 5.99 |
| Tear Index ($mN \cdot m^2/g$) | 3.74 | 4.14 | 3.50 | 3.90 |
| Burst Index ($Kpa \cdot m^2/g$) | 2.56 | 2.90 | 3.20 | 3.20 |
| Cohesion Force (kg-cm) | 2.11 | 2.34 | 2.31 | 2.15 |
| Permeability to Gases (sec/100 ml) | 550.8 | 556.5 | 930.2 | 524.0 |
| Surface Strength (A) | 12 | 13 | 13 | 13 |
| Stiffness (g-cm) | 1.52 | 1.36 | 1.36 | 1.42 |
| Opacity (%) | 97.3 | 95.6 | 97.0 | 96.5 |
| Whiteness (%) | 22.3 | 22.2 | 21.7 | 23.1 |
| Ash Content (%) | 11.6 | 11.6 | 11.3 | 11.3 |
| *General Strength | 16.26 | 17.41 | 17.56 | 17.39 |

PS: The treatments of LBY-1, LBY-4, LBY-6 and LBY-8 represent that the inoculation concentration are 0, $10^4$, $10^6$ and $10^8$ cfu/ml respectively.
*General Strength = Breaking length (Km) + Tear index ($mN \cdot m^2/g$) + Burst Index ($Kpa \cdot m^2/g$) + [Cohesion Force (kg-cm) × 2]

(4) Boiling of the pulp solution: 1% (w/v) CaO is added into the pulp solution, which is then heated up to 140° C. for 30 minutes.

(5) Generation of the pulp solution: The pulp solution is generated by further pulping for 15 minutes.

(6) Filtration of the pulp solution: The pulp solutions are sieved by sieves with 18, 200 and 270 meshes respectively for isolating the incompletely decomposed rice straw pulp from the pulp solutions. The recovery percentages of the rice straw pulp fibers sieved through sieves with different meshes are calculated. The recovered rice straw pulp fibers sieved through 200 meshes are made into the handmade papers. The physical properties of the handmade papers are tested.

(D) The effects of different fermentation culturing periods on the production of rice straw pulp fiber:

The length of fermentation culturing time can be various according to a preferred embodiment. First, an LBY liquid medium and the rice straw segments of Indica rice are prepared (the rice straws are sun-dried and cut into small segments at the length of 2-3 cm.). The LBY liquid medium is aliquoted into a sterile 1000 ml concaved-bottom flask, 500 ml per flask. The PMBPIII strain group is added into the LBY liquid media at the concentration of $1.5\times10^6$ cfu/ml. Then, the rice straw segments are added into the LBY liquid media containing the PMBIII strain group at the concentration of 5% (w/v). And then the mixed solutions are cultured in shaking culture at 200 rpm under 50° C. for 0, 1, 4, 7 and 10 days respectively. Each treatment is set up in four repetitions. Next, CaO is added into the fermentative culture solution at the concentration of 1% (w/v) and then the fermentative culture solution is boiled up to 140° C. for 30 minutes for preparing the pulp solution. The pulp solution is further pulped for 15 minutes. The pulp solutions are sieved by sieves with 18, 200 and 270 meshes respectively for isolating the incompletely decomposed rice straw pulp fibers from the pulp solutions. The recovery percentages of the rice straw pulp fibers sieved through sieves with different meshes are calculated. The recovered rice straw pulp fibers sieved through 200 meshes are made into the handmade papers. The physical properties of the handmade papers are tested.

Figure 4:
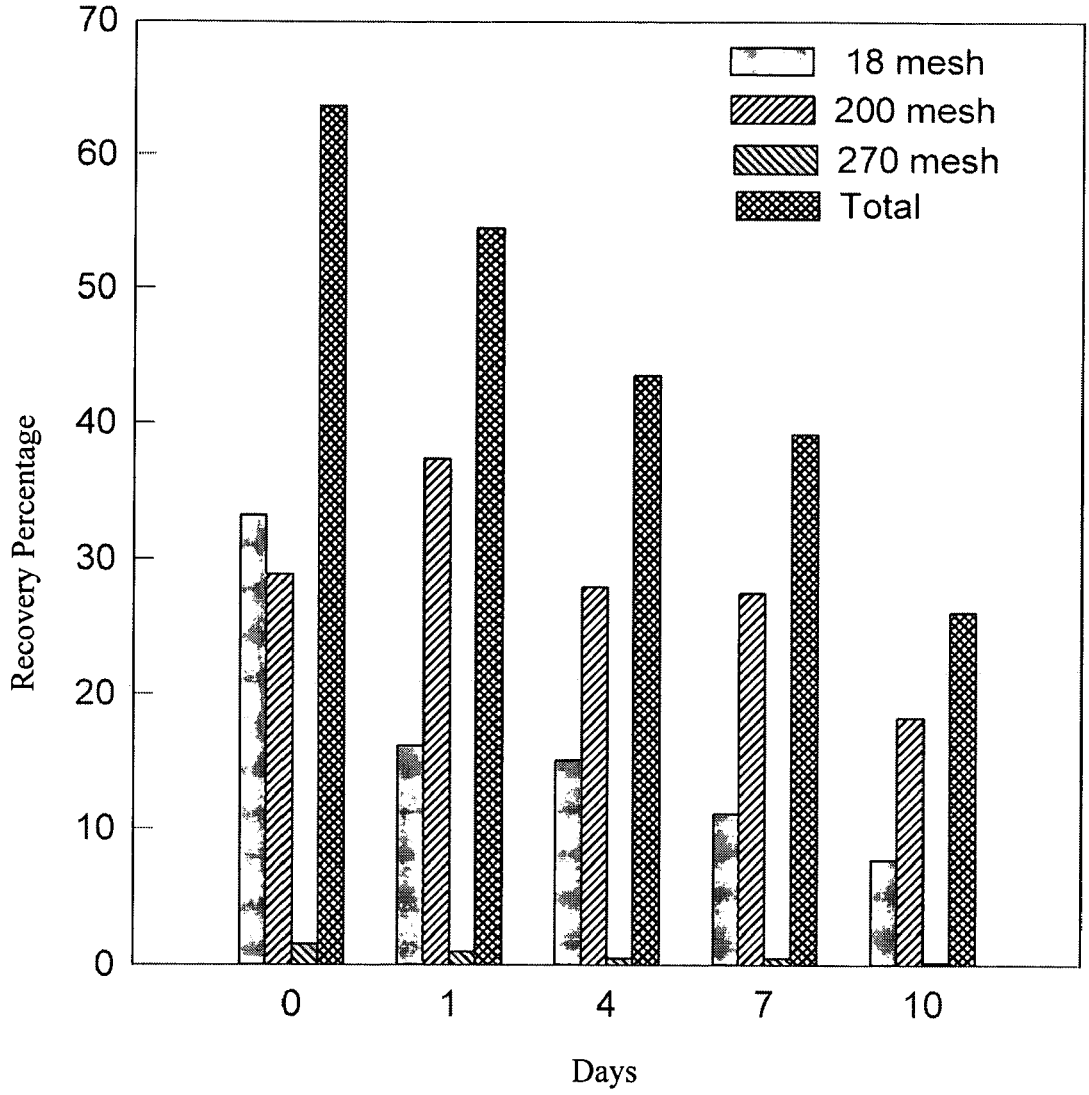
FIG. 4 is a graph showing the effects of different fermentation culturing periods on the recovery percentages of various straw pulp fibers.

Please refer to FIG. 4 and Table 3. FIG. 4 shows the effects of different fermentation culturing periods on the recovery percentages of various straw pulp fibers. The recovery percentage is decreased as the fermentation culturing period is increased. The pulp fibers recovered from the fibers sieved through 200 meshes, which are fermented for different fermentative periods, are compared. The recovery percentage of 1-day fermentative culture is higher than those of the other periods. Table 3 shows the effects of different fermentation culturing periods on the physical properties of handmade papers made from rice straw pulp fibers. The 4-day fermentative culture has the best gas permeability. And 10-day fermentative culture has the lowest gas permeability. Also, the 4-day fermentative culture has the best general strength.

TABLE 3

| Item | Treatment | | | | |
|---|---|---|---|---|---|
| | LBY-d0 C.S.F.: 209 ml | LBY-d1 C.S.F.: 227 ml | LBY-d4 C.S.F.: 179 ml | LBY-d7 C.S.F.: 138 ml | LBY-d10 C.S.F.: 198 ml |
| Basic weight ($g/m^2$) | 72.5 | 71.7 | 70.6 | 72.7 | 73.8 |
| Thickness (mm) | 0.135 | 0.126 | 0.120 | 0.126 | 0.143 |
| Bulk (ml/g) | 1.86 | 1.76 | 1.70 | 1.73 | 1.94 |
| Breaking length (Km) | 3.73 | 4.61 | 5.17 | 4.41 | 3.38 |
| Tear index ($mN \cdot m^2/g$) | 2.49 | 4.05 | 4.00 | 3.56 | 3.89 |
| Burst Index ($Kpa \cdot m^2/g$) | 1.61 | 2.45 | 2.57 | 2.01 | 1.82 |
| Cohesion Force (kg-cm) | 1.76 | 1.75 | 2.04 | 1.69 | 1.69 |
| Permeability to Gases (sec/100 ml) | 245.2 | 174.5 | 368.8 | 200.9 | 57.0 |
| Surface Strength (A) | 7 | 9 | 8 | 10 | 7 |
| Stiffness (g-cm) | 1.27 | 1.28 | 1.23 | 1.57 | 1.62 |
| Opacity (%) | 98.7 | 98.4 | 98.2 | 99.1 | 99.3 |
| Whiteness (%) | 18.1 | 22.0 | 22.0 | 24.1 | 22.3 |
| Ash Content (%) | 17.5 | 15.2 | 14.4 | 18.2 | 19.4 |
| *General Strength | 11.35 | 14.61 | 15.82 | 13.36 | 12.47 |

*General Strength = Breaking length (Km) + Tear index ($mN \cdot m^2/g$) + Burst Index ($Kpa \cdot m^2/g$) + [Cohesion Force (kg-cm) × 2]

(E) The comparison between the biopulping method and the chemical pulping method:

The following compares the differences between the biopulping method and the chemical pulping method. First, an LBY liquid medium and the rice straw segments of Indica rice are prepared (the rice straws are sun-dried and cut into small segments at the length of 2-3 cm). The LBY liquid medium is aliquoted into sterile 1000 concaved-bottom flasks, 500 ml per flask. The PMBPIII strain group is added into the LBY liquid media at the concentration of $1.5 \times 10^6$ cfu/ml. Then, the rice straw segments are added into the LBY liquid media containing PMBIII strain group at the concentration of 5% (w/v). And then the mixed solution is cultured in a shaking culture at 200 rpm under 50° C. for 4 days. Each treatment is set up in four repetitions. Next, two treatments are respectively proceeded. The first treatment (LBYIII-CaO treatment) is to add CaO into the fermentative culture solution at the concentration of 1% (w/v) and then boil the fermentative culture solution up to 140° C. for 30 minutes for preparing a pulp solution. The second treatment (LBYIII) is to directly boil the fermentative culture solution up to 140° C. for 30 minutes for preparing a pulp solution. In addition, the controls are prepared respectively such that the rice straw segments are directly mixed with 1% (w/v) sodium hydroxide solution (NaOH treatment) or 1% (w/v) CaO solution (CaO treatment). Each treatment is set up in four repetitions. The pulp solutions of all treatments are further pulped for 15 minutes. The pulp solutions are sieved by sieves with 18, 200 and 270 meshes respectively, for isolating the incompletely decomposed rice straw pulp fibers from the pulp solutions. The recovery percentages of the rice straw pulp fibers sieved through sieves with different meshes are calculated. The recovered rice straw pulp fibers sieved through 200 meshes are made into the handmade papers. The physical properties of the handmade papers are tested.

Figure 5:
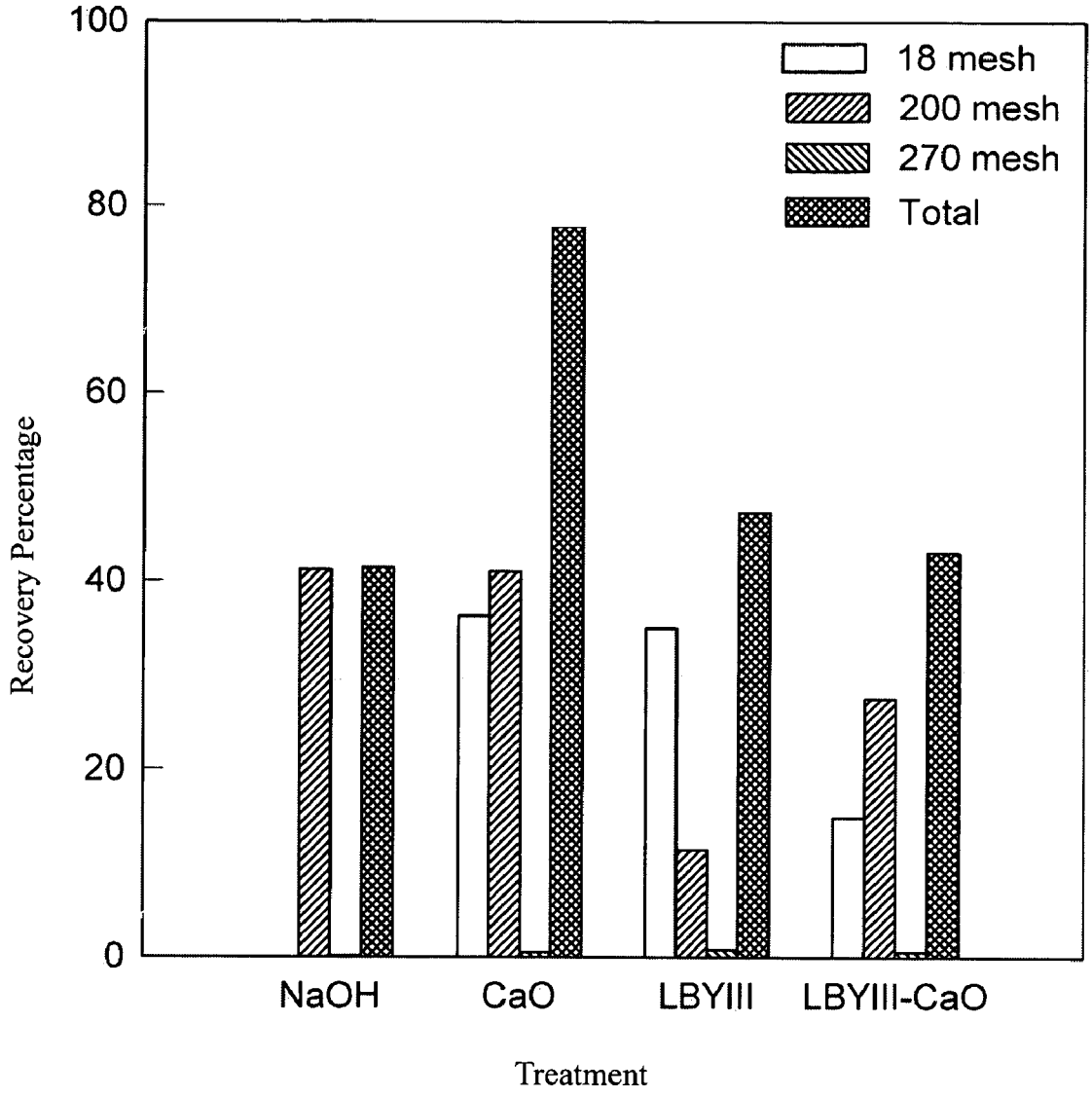
FIG. 5 is a graph showing the effects of microorganism fermentation treatment and chemical treatment on the recovery percentages of various straw pulp fibers.

Please refer to FIG. 5, which shows the effects of microorganism fermentation treatment and chemical treatment on the recovery percentages of various rice straw pulp fibers.

The total recovery percentage of CaO treatment is the highest. The recovery percentage is 77.79%. The effect of LBYIII treatment came second, in which the recovery percentage is 47.31%. The LBYIII-CaO treatment has a recovery percentage of 43.07%. The recovery percentage of NaOH treatment is 41.45%, the lowest. Comparing the recovery percentage of the pulp fibers obtained by the biopulping method and that of the chemical method, which are recovered from the fibers sieved through 200 meshes, the results of NaOH treatment and the CaO treatment are higher than the other treatments. The result of treatment by microorganism plus CaO (LBYIII-CaO treatment) came second and the result of microorganism treatment (LBYIII treatment) is the lowest. The recovery percentages of the pulp fiber recovered from the fibers sieved through 200 meshes and treated with NaOH, CaO, LBYIII-CaO and LBYIII are 41.21%, 41.0%, 27.53% and 11.45%, respectively.

Please refer to Table 4, which shows the physical properties of handmade papers produced from rice straw pulp fibers which are treated by microorganisms and chemicals. The recovered rice straw pulp fiber sieved through from 200 meshes is made into the handmade papers. The physical properties of the handmade papers are tested. The obtained pulp fiber treated by CaO has the best ionization degree (325 ml), while the obtained pulp fiber treated with LBYIII-CaO has the ionization degree of 267 ml. The handmade paper of LBYIII treatment has the highest gases permeability (302.3 sec/100 ml). The CaO treatment is the lowest (110.3 sec/100 ml). The handmade papers of both NaOH treatment and LBYIII-CaO treatment have the best surface strengths of all treatments (10A and 9A respectively). The handmade paper of the NaOH treatment has the best general strength of all (21.8). The second is the LBYIII-CaO treatment (15.13). The lowest is the LBYIII treatment.

Figure 6:
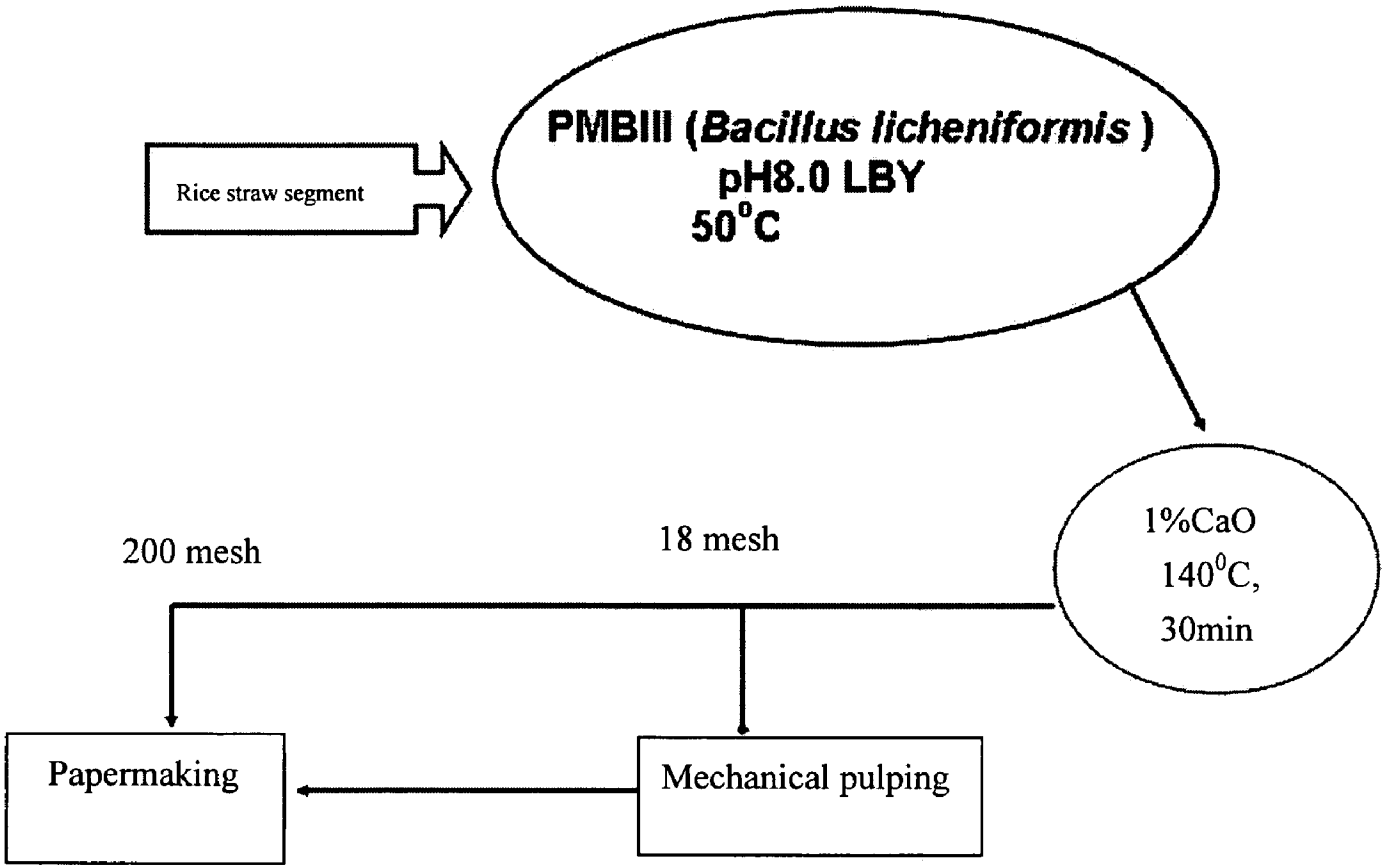
FIG. 6 shows a flow chart of a biopulping method for waste rice straw according to a preferred embodiment of the present invention.

Please refer to FIG. 6, which is the flow chart of the biopulping method illustrating the full process of the biopulping method for waste rice straws according to a preferred embodiment of the present invention. First, the rice straw is cut into segments at the length of 2-3 cm. The segments are added into the LBY medium containing $10^6$ (cfu/ml) PMB-PIII strain group. The mixed solution is cultured in the shaking culture under 50° C. and 200 rpm for four days. The culture solutions are boiled up to 140° C. for 30 minutes to prepare pulp solutions. The pulp solutions are further pulped and sieved through sieves for preparing rice straw pulp fibers. And then the papermaking procedure is begun.

While the invention has been described in terms of what is presently considered to be the most practical and preferred embodiments, it is to be understood that the invention is not limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A production method for a paper pulp, comprising steps of:

(a) providing a culture solution;

(b) adding a fiber plant into said culture solution;

(c) adding a suspension of a microorganism into said culture solution wherein said microorganism is one selected from a group consisting of a *Bacillus licheniformis* having been deposited under ATCC Accession No: PTA-5824, a *Bacillus subtilis* having been deposited under ATCC Accession No: PTA-5818, and a *Bacillus amyloliquefaciens* having been deposited under ATCC Accession No: PTA-5819;

TABLE 4

| Test item | Treatment | | | |
|---|---|---|---|---|
| | NaOH C.S.F.:252 ml | LBYIII C.S.F.:257 ml | CaO C.S.F.:325 ml | LBYIII-CaO C.S.F.:267 ml |
| Basic weight ($g/m^2$) | 72.8 | 72.9 | 73.3 | 73.4 |
| Thickness (mm) | 0.136 | 0.153 | 0.144 | 0.147 |
| Bulk (ml/g) | 1.87 | 2.10 | 1.96 | 2.00 |
| Breaking length (Km) | 7.21 | 2.87 | 3.36 | 4.89 |
| Tear Index ($mN \cdot m^2/g$) | 5.99 | 1.28 | 2.61 | 4.21 |
| Burst Index ($Kpa \cdot m^2/g$) | 4.34 | 0.89 | 1.58 | 2.47 |
| Cohesion Force (kg-cm) | 2.13 | 0.93 | 1.26 | 1.78 |
| Permeability to Gases (sec/100 ml) | 157.7 | 302.3 | 110.3 | 157.3 |
| Surface Strength (A) | 10 | 4 | 7 | 9 |
| Stiffness (g-cm) | 2.20 | 1.57 | 1.38 | 1.55 |
| Opacity (%) | 94.8 | 99.5 | 99.5 | 99.3 |
| Whiteness (%) | 43.5 | 22.7 | 20.4 | 24.9 |
| Ash Content (%) | 4.59 | 13.60 | 20.80 | 16.50 |
| *General Strength | 21.80 | 6.90 | 10.07 | 15.13 |

*General Strength = Breaking length + Tear Index + Burst Index + (Cohesion Force × 2)

(d) fermentatively culturing said culture solution for preparing a pulp solution;

(e) boiling said pulp solution;

(f) pulping said pulp solution; and (g) screening said pulp solution for isolating a paper pulp from said pulp solution.

2. The method as claimed in claim 1, wherein said fiber plant is a non-woody fiber plant.

3. The method as claimed in claim 1, wherein said fiber plant is pretreated by one selected from a group consisting of a relatively high pressure treatment under a relatively high temperature, a steaming treatment under a relatively high temperature, a boiling treatment under a relatively high temperature, a fumigated treatment and a soaking treatment under a room temperature.

4. The method as claimed in claim 1, wherein said fiber plant is added into said culture solution in a ratio ranged from 4 to 15% (w/v).

5. The method as claimed in claim 1, wherein said microorganism is inoculated at a concentration ranged from 0 to $10^8$ cfu/ml.

6. The method as claimed in claim 1, wherein said microorganism is a Gram positive bacterium.

7. The method as claimed in claim 1, wherein said fermentatively culturing process is proceeded at a temperature ranged from 20 to 50° C.

8. The method as claimed in claim 1, wherein said fermentatively culturing process is one of a static culture and a shaking culture.

9. The method as claim in claim 1, wherein said fermentatively culturing process is proceeded over 0 to 10 days.

10. The method as claimed in claim 1, wherein said step (e) further comprises a step of adding CaO with a concentration ranged from 0 to 4% (w/v) into said pulp solution and boiling said pulp solution for 25 to 40 minutes within a temperature ranged from 120° C. to 150° C.

11. The method as claim in claim 1, wherein said pulp solution is screened by 18 to 300 meshes.

12. A biopulping method for a non-woody fiber plant, comprising steps of:

(a) providing a culture solution;

(b) adding a non-woody fiber plant into said culture solution;

(c) adding a suspension of a microorganism into said culture solution wherein said microorganism is one selected from a group consisting of a *Bacillus licheniformis* having been deposited under ATCC Accession NO: PTA-5824, a *Bacillus subtilis* having been deposited under ATCC Accession NO: PTA-5818 and a *Bacillus amyloliquefaciens* having been deposited under ATCC Accession NO: PTA-5819

(d) fermentatively culturing said culture solution for preparing a pulp solution;

(e) boiling said pulp solution;

(f) pulping said pulp solution; and (g) screening said pulp solution for isolating a paper pulp from said pulp solution.

13. The method as claimed in claim 12, wherein said fiber plant is pretreated by one selected from a group consisting of a relatively high pressure treatment under a relatively high temperature, a steaming treatment under a relatively high temperature, a boiling treatment under a relatively high temperature, a fumigated treatment and a soaking treatment under a room temperature.

14. The method as claimed in claim 12, wherein said inoculation concentration of a microorganism is at a range from 0 to $10^8$ cfu/ml.

15. The method as claimed in claim 12, wherein said step (e) further comprises a step of adding CaO with a concentration ranged from 0 to 4% (w/v) into said pulp solution and boiling said pulp solution for 25 to 40 minutes within a temperature ranged from 120° C. to 150° C.

16. The method as claim in claim 12, wherein said pulp solution is screened by 18 to 300 meshes.

* * * * *